US012618614B2

(12) United States Patent
Lee et al.

(10) Patent No.: US 12,618,614 B2
(45) Date of Patent: May 5, 2026

(54) REFRIGERATOR

(71) Applicant: SAMSUNG ELECTRONICS CO., LTD., Suwon-si (KR)

(72) Inventors: Yeongjun Lee, Suwon-si (KR); Jinhong Yu, Suwon-si (KR); Kyoungsun Park, Suwon-si (KR); Jisick Hwang, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 172 days.

(21) Appl. No.: 18/213,657

(22) Filed: Jun. 23, 2023

(65) Prior Publication Data

US 2023/0332828 A1 Oct. 19, 2023

Related U.S. Application Data

(63) Continuation of application No. PCT/KR2022/000222, filed on Jan. 6, 2022.

(30) Foreign Application Priority Data

Feb. 24, 2021 (KR) ..... 10-2021-0025079

(51) Int. Cl.
*F25D 25/02* (2006.01)
*F25D 17/06* (2006.01)
(Continued)

(52) U.S. Cl.
CPC ..... *F25D 25/025* (2013.01); *F25D 17/08* (2013.01); *F25D 23/067* (2013.01); *F25D 11/02* (2013.01); *F25D 23/087* (2013.01); *F25D 25/02* (2013.01)

(58) Field of Classification Search
CPC ..... F25D 25/025; F25D 17/08; F25D 17/062; F25D 25/02; F25D 17/045; F25D 23/067;
(Continued)

(56) References Cited

U.S. PATENT DOCUMENTS 4,960,308 A * 10/1990 Donaghy ..... F25D 25/025 D15/89
5,918,959 A 7/1999 Lee
(Continued)

FOREIGN PATENT DOCUMENTS

CN 102901317 B 9/2014
CN 105241169 A * 1/2016
(Continued)

OTHER PUBLICATIONS

International Search Report & Written Opinion(PCT/ISA/210 & 237) issued May 4, 2022 from the International Searching Authority in International Application No. PCT/KR2022/000222.
(Continued)

*Primary Examiner* — Kimberley S Wright
(74) *Attorney, Agent, or Firm* — Sughrue Mion, PLLC

(57) ABSTRACT

A refrigerator includes a storage compartment; a shelf provided in the storage compartment; a shelf frame provided at a lower side of the shelf and configured to support the shelf; a drawer configured to be withdrawn at a lower side of the shelf frame; a drawer cover coupled to the shelf frame between the shelf frame and the drawer, the drawer cover including a cold air blocking portion extending toward a front of the storage compartment; and a support member contacting a portion of a bottom surface of the shelf frame and configured to support a load of the shelf.

12 Claims, 13 Drawing Sheets

(51) Int. Cl.

| | |
|---|---|
| ***F25D 17/08*** | (2006.01) |
| ***F25D 23/06*** | (2006.01) |
| *F25D 11/02* | (2006.01) |
| *F25D 23/08* | (2006.01) |

(58) Field of Classification Search
CPC ..... F25D 11/02; F25D 2317/061; A47B 2210/175
See application file for complete search history.

(56) References Cited

U.S. PATENT DOCUMENTS

| | | | | |
|---|---|---|---|---|
| 8,376,482 | B2 | 2/2013 | An et al. | |
| 8,529,000 | B2 | 9/2013 | Lim et al. | |
| 9,062,910 | B2 | 6/2015 | Kim et al. | |
| 10,458,699 | B2 | 10/2019 | Park et al. | |
| 10,591,203 | B2 | 3/2020 | Kang et al. | |
| 10,823,492 | B2 | 11/2020 | Oh | |
| 2011/0023530 | A1 | 2/2011 | An et al. | |
| 2011/0127896 | A1* | 6/2011 | Anderson | F25D 25/025 29/890.035 |
| 2013/0257253 | A1* | 10/2013 | Haltmeyer | F25D 25/025 312/404 |
| 2016/0153699 | A1* | 6/2016 | Lee | F25D 23/025 312/270.3 |
| 2016/0356538 | A1* | 12/2016 | Park | F25D 25/025 |
| 2018/0187966 | A1 | 7/2018 | Lee et al. | |
| 2019/0365099 | A1 | 12/2019 | Wantland et al. | |
| 2020/0011594 | A1 | 1/2020 | Park et al. | |
| 2020/0224959 | A1 | 7/2020 | Wantland et al. | |

FOREIGN PATENT DOCUMENTS

| | | | | | |
|---|---|---|---|---|---|
| CN | 106322909 | A | * | 1/2017 | F25D 25/025 |
| CN | 104501519 | B | | 2/2017 | |
| CN | 107036363 | A | * | 8/2017 | F25D 17/045 |
| CN | 108088166 | B | | 11/2019 | |
| CN | 110953815 | A | * | 4/2020 | |
| CN | 114061212 | A | * | 2/2022 | F25D 11/00 |
| EP | 3 627 082 | A1 | | 3/2020 | |
| JP | 10-197143 | A | | 7/1998 | |
| JP | 2008-104442 | A | | 5/2008 | |
| KR | 10-2005-0057995 | A | | 6/2005 | |
| KR | 10-0844329 | B1 | | 7/2008 | |
| KR | 10-2009-0106935 | A | | 10/2009 | |
| KR | 10-2009-0129076 | A | | 12/2009 | |
| KR | 10-2009-0133008 | A | | 12/2009 | |
| KR | 20090128905 | A | * | 12/2009 | |
| KR | 10-2011-0036446 | A | | 4/2011 | |
| KR | 101480457 | B1 | | 1/2015 | |
| KR | 10-2016-0143412 | A | | 12/2016 | |
| KR | 10-1810736 | B1 | | 12/2017 | |
| KR | 10-2001929 | B1 | | 10/2019 | |
| KR | 10-2020-0025250 | A | | 3/2020 | |

OTHER PUBLICATIONS

Communication issued on May 21, 2024 by the European Patent Office for European Patent Application No. 22759893.5.
Communication issued on Sep. 30, 2025 by the European Patent Office in European Patent Application No. 22759893.5.

* cited by examiner

REFRIGERATOR

This application is by-pass continuation application of International Application No. PCT/KR2022/000222, filed on Jan. 6, 2022, which based on and claims priority to Korean Patent Application No. 10-2021-0025079, filed on Feb. 24, 2021, in the Korean Intellectual Property Office, the disclosures of which are incorporated by reference herein in their entireties.

BACKGROUND

1. Field

The disclosure relates to a refrigerator having an improved structure of supporting a shelf.

2. Description of Related Art

A refrigerator is a home appliance that is equipped with a storage compartment storing food and a cold air supply device, supplying cold air to the storage compartment, and keeps food in a fresh state.

The temperature of the storage compartment is maintained within a certain range required to keep food fresh.

The storage compartment of the refrigerator is provided with a front side that is open, and the open front side is normally closed by a door to maintain the temperature of the storage compartment.

The storage compartment is provided inside the refrigerator with a shelf, dividing the storage compartment into a plurality of zones, and a drawer having an inner space for storing food and the like. Such a drawer has a shape whose upper side is open, and the drawer is generally provided to be withdrawn at a lower side of a shelf. In addition, the shelf is formed of a transparent material, such as glass and the like, to allow the user to observe the inside of the drawer from the upper side of the shelf.

However, in order to prevent sagging of the shelf when heavy articles are stacked on the top of the shelf, a relatively thick glass may be used or a separate member for reinforcing strength may be coupled, which may result in a complicated structure and an increase in material cost.

In addition, the internal temperature of the drawer may be individually adjusted according to the user's convenience. However, through a gap between the drawer and the shelf, cold air inside the drawer may leak into the storage compartment, making it difficult to implement the set temperature in the drawer.

SUMMARY

According to an aspect of the disclosure, a refrigerator includes: a storage compartment; a shelf provided in the storage compartment: a shelf frame provided at a lower side of the shelf and configured to support the shelf: a drawer configured to be withdrawn at a lower side of the shelf frame: a drawer cover coupled to the shelf frame between the shelf frame and the drawer, the drawer cover including a cold air blocking portion extending toward a front of the storage compartment; and a support member contacting a portion of a bottom surface of the shelf frame and configured to support a load of the shelf.

The support member may include: a shelf support portion including a surface parallel to the shelf frame and contacting the shelf frame; and a leg portion extending downward from the shelf support portion.

The refrigerator may further include: a plurality of drawers including the drawer and a second drawer; and inner rails to which inner sides of the plurality of drawers are respectively coupled in a sliding manner.

The support member may further include: an extension portion extending horizontally outward from an end of the leg portion; and a locking portion protruding from the extension portion and toward at least one of the inner rails.

The inner rails may include an insertion portion configured to receive the locking portion and lock the support member in position.

The refrigerator may further include: a sub-drawer provided between the drawer and the second drawer, the sub-drawer may be slidably coupled to the inner rails, and the sub-drawer may be at least partly disposed inside of the support member.

The drawer may include: a storage box; and a cover panel coupled to a front side of the storage box and including a grip.

The cover panel may further include an edge frame surrounding an opening portion that is open to an inside of the drawer.

The cold air blocking portion may extend from the edge frame to a side of the cover panel of the drawer and cover a gap between the shelf frame and the cover panel.

The drawer cover may further include a side rib extending from the edge frame and toward a side surface of the storage compartment, and the side rib may cover a gap between the shelf frame and the storage box.

The shelf frame may include: an opening that is open to the opening portion of the drawer cover; and a cover portion supported by the support member.

The shelf frame may include a shelf seating portion on which the shelf is seated, and the shelf seating portion may be stepped inward from an upper surface of the shelf frame.

The refrigerator may further include a trim coupled to a front side of the shelf frame, and the trim is configured to press the shelf seated on the shelf seating portion from an upper side.

The refrigerator may further include a duct mounted on a rear surface of the storage compartment, the duct may be configured to supply air into the storage compartment, the duct may include an air discharge hole, and the drawer cover may further include an air inlet in communication with the air discharge hole.

The shelf frame may include a support rib on the bottom surface, and the drawer cover may include a mounting protrusion protruding to an inside of the support rib and configured to keep the drawer cover in position by engagement with the support rib. According to one or more embodiments, a shelf frame is supported with a support member, a shelf having a relatively thin thickness is provided, and thus the shelf can be supported with a simpler structure and material costs can be reduced.

In addition, according to one or more embodiments, through a cold air blocking portion provided for a drawer cover, cold air inside of a drawer leaking through a gap between the drawer and the shelf frame can be minimized.

BRIEF DESCRIPTION OF THE DRAWINGS

The above and other aspects, features, and advantages of certain embodiments of the present disclosure will be more apparent from the following description taken in conjunction with the accompanying drawings, in which.

In connection with the description of the drawings, like or similar reference numerals may be used for like or similar elements.

DETAILED DESCRIPTION

Figure 1:
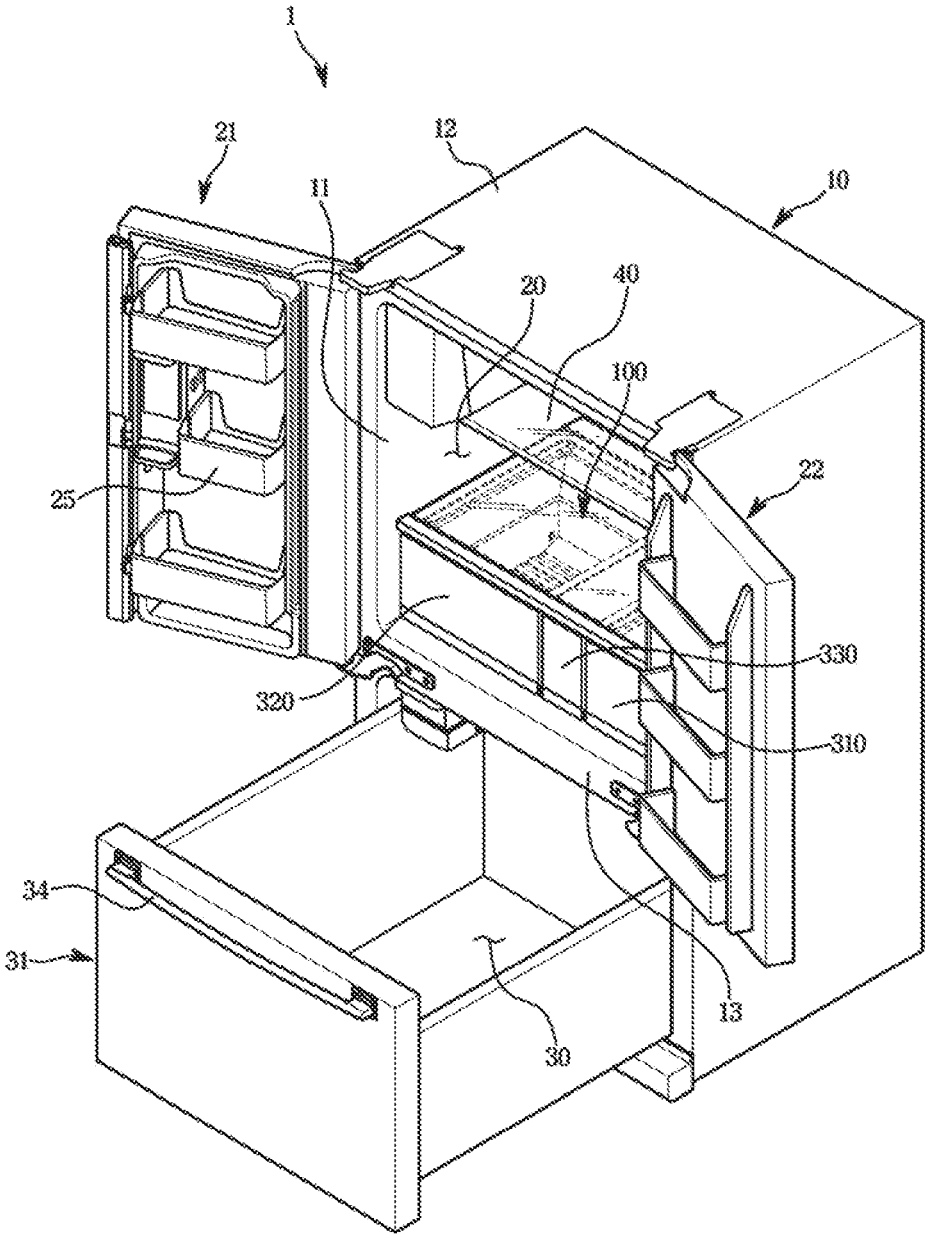
FIG. 1 is a perspective view illustrating a refrigerator according to an embodiment of the present disclosure.

Embodiments described in the specification and configurations shown in the accompanying drawings are merely exemplary examples of the present disclosure, and various modifications may replace the embodiments and the drawings of the present disclosure at the time of filing of the present application.

Further, identical symbols or numbers in the drawings of the present disclosure denote components or elements configured to perform substantially identical functions.

Further, terms used herein are only for the purpose of describing particular embodiments and are not intended to limit to the present disclosure. The singular form is intended to include the plural form as well, unless the context clearly indicates otherwise. It should be further understood that the terms "include," "including," "have," and/or "having" specify the presence of stated features, integers, steps, operations, elements, components, and/or groups thereof, but do not preclude the presence or addition of one or more other features, integers, steps, operations, elements, components, and/or groups thereof.

Further, it should be understood that, although the terms "first," "second," etc. may be used herein to describe various elements, the elements are not limited by the terms, and the terms are only used to distinguish one element from another. For example, a first element could be termed a second element, and similarly, a second element could be termed a first element without departing from the scope of the present disclosure. The term "and/or" includes combinations of one or all of a plurality of associated listed articles.

Hereinafter, embodiments according to the disclosure will be described in detail with reference to the accompanying drawings.

FIG. 1 is a perspective view illustrating a refrigerator 1 according to an embodiment of the present disclosure.

Referring to FIG. 1, a refrigerator 1 may include a main body 10. The main body 10 may include an inner case 11 and an outer case 12.

The outer case 12 may form the external appearance of the refrigerator 1 and may be formed of a metal material having excellent durability and aesthetics. However, the material is not limited thereto.

The inner case 11 may be located inside of the outer case 12. The inner case 11 may be provided to form a plurality of storage compartments, such as a storage compartment 20 and a storage compartment 30, inside the refrigerator 1. The inner case 11 may be formed of a resin material and integrally injection-molded. A heat insulating material may be formed between the inner case 11 and the outer case 12 to ensure insulation of the refrigerator 1.

The refrigerator 1 includes a plurality of storage compartments, such as the storage compartment 20 and the storage compartment 30, provided in the main body 10 such that articles may be inserted or withdrawn.

The plurality of storage compartments, such as the storage compartment 20 and the storage compartment 30, may be vertically divided inside the main body 10.

The plurality of storage compartments, such as the storage compartment 20 and the storage compartment 30, may be formed to have a front side or an upper side open such that articles may be inserted or withdrawn therethrough.

The plurality of storage compartments may include a first storage compartment 20 and a second storage compartment 30. The first storage compartment 20 and the second storage compartment 30 may be vertically divided by a partition wall 13.

The first storage compartment 20 may be provided in an upper portion of the refrigerator 1, and the second storage compartment 30 may be provided in a lower portion of the refrigerator 1.

The refrigerator 1 may include a refrigerating compartment and a freezing compartment. Depending on the type of refrigerator 1, the first storage compartment 20 provided on the upper side may serve as a refrigerating compartment, and the second storage compartment 30 provided on the lower side may serve as a freezing compartment. However, the locations of the refrigerating compartment and the freezing compartment are not limited thereto and may be configured in various ways.

The refrigerator 1 shown in FIG. 1 may be provided as a refrigerator 1 in which the first storage compartment 20 located on the upper side serves as a refrigerating compartment and the second storage compartment 30 located on the lower side serves as a freezing compartment. The refrigerating compartment may be maintained at about 3° C., and the freezing compartment may be maintained at about −20° C.

The plurality of storage compartments 20 and 30 may be opened and closed by a plurality of doors, such as a first door 21, a second door 22, and a third door 31.

The first storage compartment 20 may be opened and closed by a first door 21 and a second door 22 rotatably coupled to the main body 10.

The first door 21 may be provided to open and close a portion of the open front side of the first storage compartment 20. The second door 22 may be provided to open and close the remaining portion of the open front side of the first storage compartment 20.

The second storage compartment 30 may be opened and closed by a third door 31 slidably coupled to the main body 10. A handle 34 may be provided at an upper end of the third door 31 so as to be gripped by a user. However, the shape and operation of the third door 31 is not limited thereto and may be provided in various forms as long as it can open and close the second storage compartment 30.

A door guard 25 for storing articles may be provided on rear surfaces of the first door 21 and the second door 22. The door guard 25 may be provided to store articles of small volume.

The refrigerator 1 may include a cooling system provided to supply cold air to the plurality of storage compartments, such as the storage compartment 20 and the storage compartment 30.

The cooling system may include a compressor, a condenser, an expansion valve, an evaporator, and a blowing fan. The cooling system may be disposed in a machine room provided on a rear lower side of the main body 10.

Meanwhile, the refrigerator 1 may include a variable shelf 40, a shelf assembly 100, a plurality of drawers, such as a drawer 310 and a drawer 320, and a sub-drawer 330.

The variable shelf 40 may be provided to have a variable height inside the storage compartment of the refrigerator 1. The load of the variable shelf 40 may be supported by a bead formed on the inner case 11. However, the support form of the variable shelf 40 is not limited thereto.

The shelf assembly 100 may be provided on the upper side of the plurality of drawers, such as the first drawer 310 and the second drawer 320, and the sub-drawer 330. Accordingly, the shelf assembly 100 may be provided to cover open upper sides of the plurality of drawers, such as the first drawer 310 and the second drawer 320, and the sub-drawer 330. Details thereof will be described below.

In addition, in FIG. 1, the sub-drawer 330 is illustrated between the plurality of drawers, such as the first drawer 310 and the second drawer 320, so as to be withdrawable, but it may not be limited thereto. For example, a compact component, such as a water filter, may be disposed between the plurality of drawers, such as the first drawer 310 and the second drawer 320.

Figure 2:
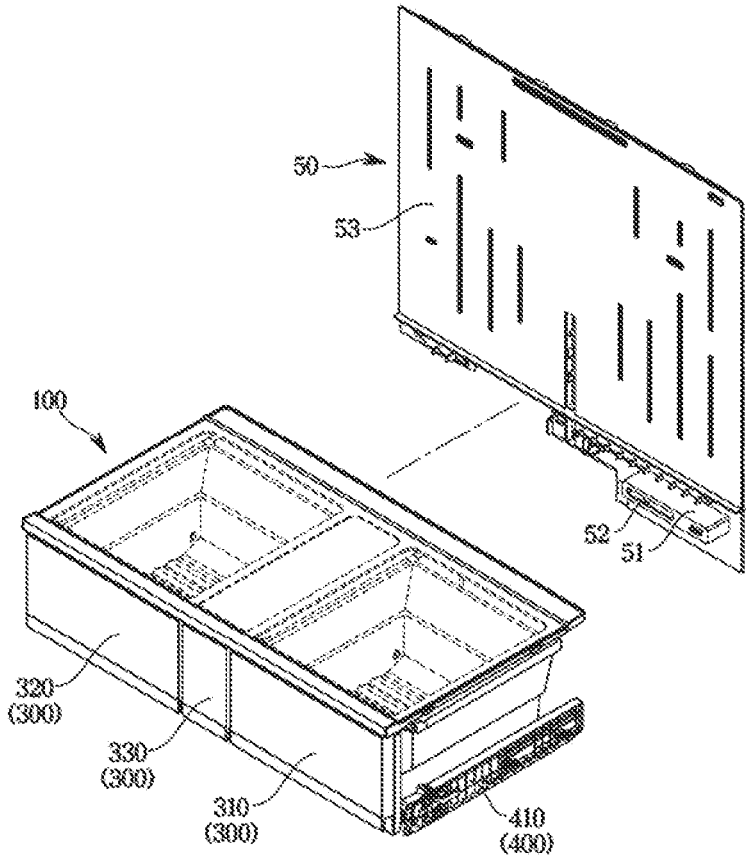
FIG. 2 is a view illustrating a duct, a shelf assembly, a drawer, and a sub-drawer of a refrigerator according to an embodiment of the present disclosure.
Figure 3:
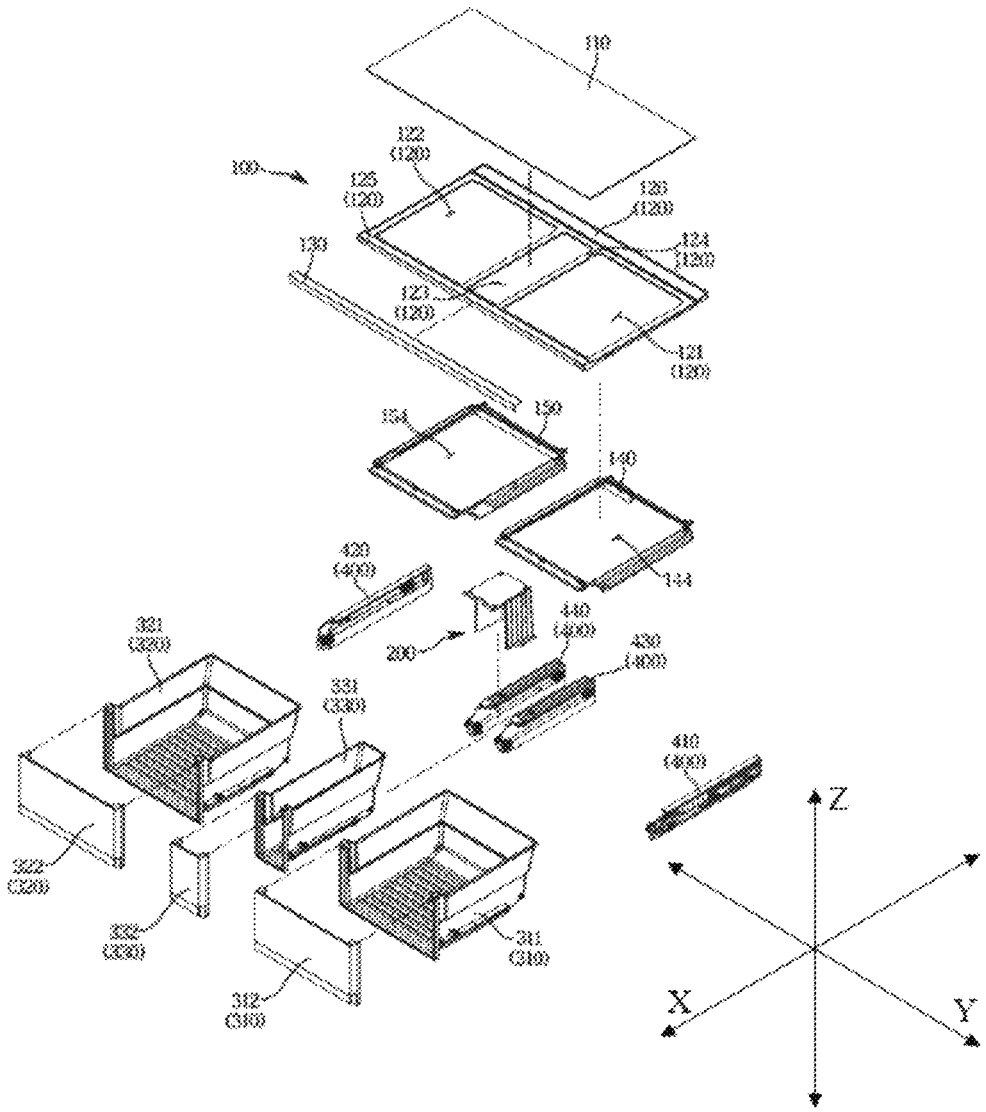
FIG. 3 is an exploded perspective view illustrating components shown in FIG. 2.

FIG. 2 is a view illustrating a duct 50, a shelf assembly 100, a first drawer 310, a second drawer 320, and a sub-drawer 330 of a refrigerator 1 according to an embodiment of the present disclosure. FIG. 3 is an exploded perspective view illustrating components shown in FIG. 2.

Referring to FIG. 2, the duct 50 may be mounted on the rear surface of a storage compartment. The duct 50 may be provided to flow cold air generated through the cooling system of the refrigerator 1 into the plurality of storage compartments, such as the storage compartment 20 and the storage compartment 30. More specifically, the duct 50 may be coupled to the rear surface of the inner case 11.

The duct 50 may be provided to cover the most area of the rear surface of the inner case 11 by being mounted on the rear surface of the inner case 11. The surface shape of the duct 50 may be provided in a flat shape or a curved shape. However, the surface shape of the duct 50 is not limited thereto.

The duct 50 may include a cover unit 53. The cover unit 53 may be a part positioned at the frontmost side of the duct 50 and may be exposed to the storage compartment.

The duct 50 may include a cold air outlet 51 and a cold air discharge hole 52.

The cold air outlet 51 may be provided on a lower side of the cover unit 53 of the duct 50. Cold air generated from the cooling system of the refrigerator 1 may be supplied to the drawer through the cold air discharge hole 52 formed in the cold air outlet 51. More specifically, the cold air discharge hole 52 of the duct 50 may be provided to communication with a cold air inlet (such as inlet 142 illustrated in FIG. 8) of the drawer to be described below, so that the cold air may be supplied into the drawer.

In FIG. 2, the cold air outlet 51 is illustrated as being formed on a side of the first drawer 310 such that the first drawer 310 is separately supplied with cold air, but the location of the cold air outlet 51 is not limited thereto. For example, the cold air outlet 51 may be formed on a side of the second drawer 320 such that the second drawer 320 may be separately supplied with cold air.

The shelf assembly 100 and the plurality of drawers 310 and 320 and the sub-drawer 330 provided to be withdrawn at a lower side of the shelf assembly 100 may be disposed in front of the duct 50.

Referring to FIG. 2 and to FIG. 3, the refrigerator 1 may include a shelf assembly 100.

The shelf assembly 100 may include a shelf 110 and a shelf frame 120.

The shelf 110 may be formed of a transparent material such that a user may observe the inside of the plurality of drawers, such as the first drawer 310 and the second drawer 320. The shelf 110 may include a glass material. However, the material of the shelf 110 may not be limited thereto.

The shelf 110 may be provided to hold articles in a storage compartment.

The shelf frame 120 may be provided on the lower side of the shelf 110 to support the shelf 110.

The shelf frame 120 may include a first opening 121 and a second opening 122. The first opening 121 and the second opening 122 may be formed at substantially symmetrical positions. The first opening 121 may communicate with the inside of the first drawer 310. The second opening 122 may communicate with the inside of the second drawer 320.

The shelf frame 120 may include a front frame portion 125, a rear frame portion 126, and a shelf seating portion 124.

The front frame portion 125 is a part formed on the front side of the shelf frame 120 and on which a trim 130, also described below, may be mounted. The rear frame portion 126 is a part formed on the rear side of the shelf frame 120. Specifically, the front frame portion 125 and the rear frame portion 126 may form a portion of the upper surface of the shelf frame 120.

The shelf seating portion 124 may be provided to seat the shelf 110 thereon. The shelf mounting portion 124 may be formed to be stepped inward from the upper surface of the shelf frame 120.

More specifically, the shelf seating portion 124 may be formed lower than the heights of the front frame portion 125 and the rear frame portion 126. With such a configuration, the shelf 110 may be stably seated and supported on the shelf mounting portion 124 and prevented from moving forward and backward by the front frame portion 125 and the rear frame portion 126.

The shelf frame 120 may include a cover portion 123.

The cover portion 123 may be provided between the first opening 121 and the second opening 122. The cover portion 123 may be formed as a closed surface to be supported by a support member 200 to be described below. Specifically, the cover portion 123 may be recessed inward of the shelf seating portion 124 to have a height lower than that of the shelf seating portion 124.

In addition, the shelf frame 120 may include the front frame portion 125 and the rear frame portion 126, but may not include a separate side frame portion formed on a lateral side of the shelf frame 120. With such a configuration, the shelf 110 may be mounted on the shelf frame 120 in a wider area along the left-right direction of the shelf frame 120, and the internal aesthetics may be improved. In this case, the left and right movement of the shelf 110 may be prevented by the inner case 11 forming the storage compartment.

The shelf assembly 100 may include a trim 130.

The trim 130 may be coupled to the front of the shelf frame 120. More specifically, the trim 130 may be coupled to surround the front frame portion 125 of the shelf frame 120.

The trim 130 may be provided to press the shelf 110 seated on the shelf mounting portion 124 from the above. Specifically, the trim 130 may be provided to press a portion of the upper surface of the shelf 110 to prevent the shelf 110 from being separated upward from the shelf frame 120. Details thereof are further described below.

In addition, the trim 130 is a component located at the frontmost side of the shelf assembly 100 and may be provided to improve the internal aesthetics.

The shelf assembly 100 may include a first drawer cover 140 and a second drawer cover 150.

The first drawer cover 140 may be coupled to the shelf frame 120 between the shelf frame 120 and the first drawer 310. The second drawer cover 150 may be coupled to the shelf frame 120 between the shelf frame 120 and the second drawer 320.

The first drawer cover 140 may include a first opening portion 144. The first opening portion 144 may be provided to communicate with the first opening 121 of the shelf frame 120. That is, the first opening portion 144 may be provided to communicate with the inside of the first drawer 310 and communicate with the first opening 121 of the shelf frame 120.

Therefore, through the shelf 110 formed of a transparent material, the user may easily check the articles inside the first drawer 310 without opening the first drawer 310.

The second drawer cover 150 may include a second opening portion 154. The second opening portion 154 may be provided to communicate with the second opening 122 of the shelf frame 120. That is, the second opening portion 154 may communicate with the inside of the second drawer 320 and communicate with the second opening 122 of the shelf frame 120. Accordingly, the user may also easily check the articles inside the second drawer 320.

Details of the first drawer cover 140 and the second drawer cover 150 are further described below.

The refrigerator 1 may include a support member 200.

The support member 200 may be provided to be in contact with a portion of the bottom surface of the shelf frame 120 to support the load of the shelf 110. More specifically, the support member 200 may be provided to support the load of the shelf frame 120, the shelf 110, and articles placed on the shelf 110.

The support member 200 may be supported by a pair of inner rails 430 and 440 to be described below. Details thereof will be described below.

The refrigerator 1 may include a drawer unit 300.

The drawer unit 300 may include a plurality of drawers, such as the first drawer 310 and the second drawer 320.

The plurality of drawers, such as the first drawer 310 and the second drawer 320, may be disposed on the left and right sides of the storage compartment, respectively. More specifically, the plurality of drawers, such as the first drawer 310 and the second drawer 320, may be provided as a pair.

The first drawer 310 may be provided on the right side with respect to the front of the storage compartment. The first drawer 310 may be provided to be withdrawn at the lower side of the shelf frame 120. The first drawer 310 may include a first storage box 311 and a first cover panel 312.

The first storage box 311 may be provided in a box shape with a upper side and a front side that are open. Articles, such as various foods and fruits, may be stored inside the first storage box 311.

The first cover panel 312 may be coupled to the front of the first storage box 311 and have a grip to be gripped by the user. The first cover panel 312 may be provided to cover the open front side of the first storage box 311. The first cover panel 312 may be provided in a substantially rectangular shape.

The second drawer 320 may be provided on the left side with respect to the front side of the storage compartment. The second drawer 320 may be provided to be withdrawn at the lower side of the shelf frame 120. The second drawer 320 may include a second storage box 321 and a second cover panel 322.

The second storage box 321 may be provided in a box shape with an upper side and a front side that are open. Articles, such as various foods and fruits, may be stored inside the second storage box 321.

The second cover panel 322 may be coupled to the front of the second storage box 321 and have a grip to be gripped by the user. The second cover panel 322 may be provided to cover the open front side of the second storage box 321. The second cover panel 322 may be provided in a substantially rectangular shape.

Accordingly, the first drawer 310 and the second drawer 320 may be provided in symmetrical shapes.

The refrigerator 1 may include a rail unit 400. The rail unit 400 may include a pair of inner rails, such as a first inner rail 430 and a second inner rail 440, and a pair of outer rails, such as a first outer rail 410 and a second outer rail 420.

The pair of inner rails may include a first inner rail 430 and a second inner rail 440. The pair of outer rails may include a first outer rail 410 and a second outer rail 420.

The first drawer 310 may be slidably coupled to the first outer rail 410 and the first inner rail 430. The second drawer 320 may be slidably coupled to the second outer rail 420 and the second inner rail 440.

In other words, the pair of inner rails, such as the first inner rail 430 and the second inner rail 440, may be provided such that inner sides of the plurality of drawers, such as the first drawer 310 and the second drawer 320, are respectively coupled thereto in a sliding manner. In addition, the pair of outer rails, such as the first outer rail 410 and the second outer rail 420, may be provided such that outer sides of the plurality of drawers 310 and 320 are respectively coupled thereto in a sliding manner.

The drawer unit 300 may include a sub-drawer 330.

The sub-drawer 330 may be provided between the plurality of drawers, such as the first drawer 310 and the second drawer 320. The sub-drawer 330 may be provided to be withdrawn on the lower side of the shelf frame 120. The sub-drawer 330 may be slidably coupled to the pair of inner rails, such as the first inner rail 430 and the second inner rail 440.

The sub-drawer 330 may include a sub storage box 331 and a sub cover panel 332. The sub storage box 331 may be provided in a box shape with an upper side and a front side that are open. Articles, such as various foods and fruits, may be stored inside the sub storage box 331.

The sub cover panel 332 may be coupled to the front of the sub storage box 331 to be gripped by the user. The sub cover panel 332 may be provided to cover the open front side of the sub storage box 331. The sub cover panel 332 may be provided in a substantially rectangular shape.

However, aspects of this disclosure are not limited to the above-described embodiment, and the first cover panel 312 and the first storage box 311 may be integrally formed with each other. The second cover panel 322 and the second storage box 321 may also be integrally formed with each other, and the sub cover panel 332 and the sub storage box 331 may also be integrally formed with each other.

The sub-drawer 330 may be movably disposed inside of the support member 200. Accordingly, the operation of the sub-drawer 330 may not be interfered by the support member 200. Details thereof are described below.

Figure 4:
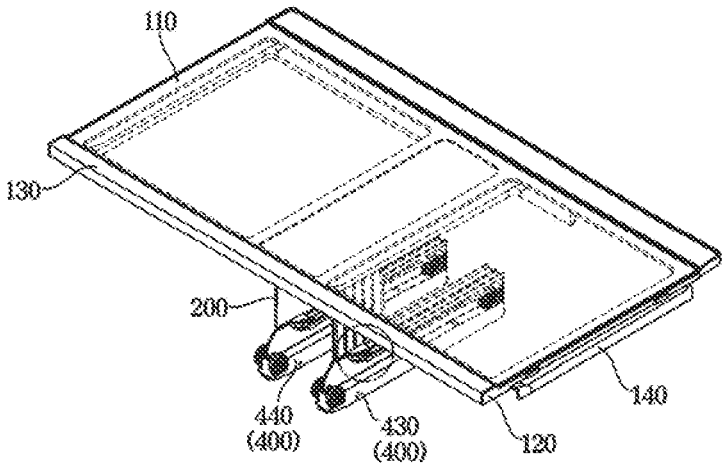
FIG. 4 is a perspective view illustrating a state in which a support member of a refrigerator is mounted on an inner rail according to an embodiment of the present disclosure.
Figure 5:
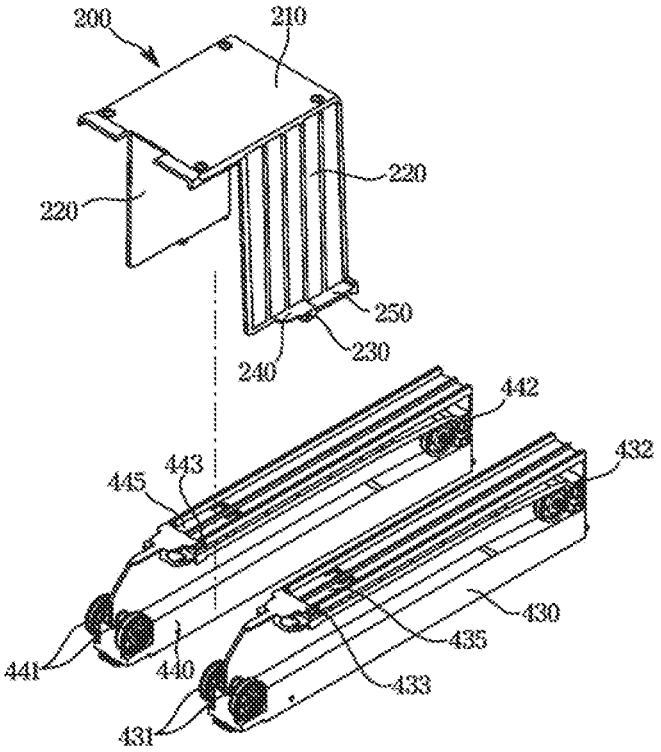
FIG. 5 is an exploded perspective view illustrating the support member and the inner rail shown in FIG. 4.
Figure 6:
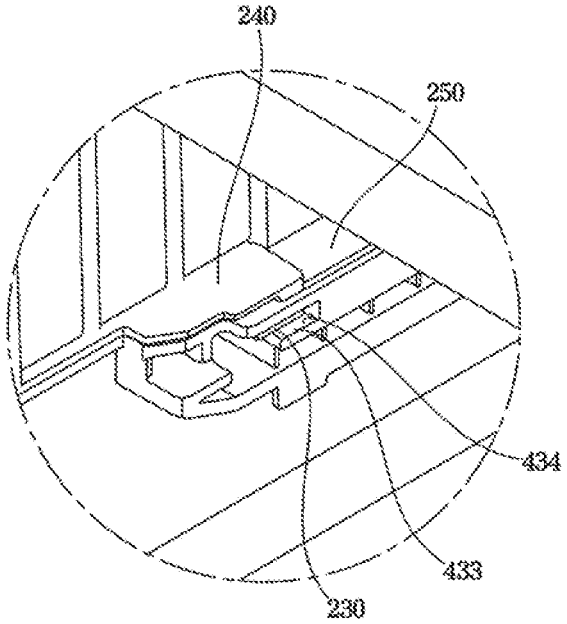
FIG. 6 is an enlarged view of a part indicated in FIG. 4.
Figure 7:
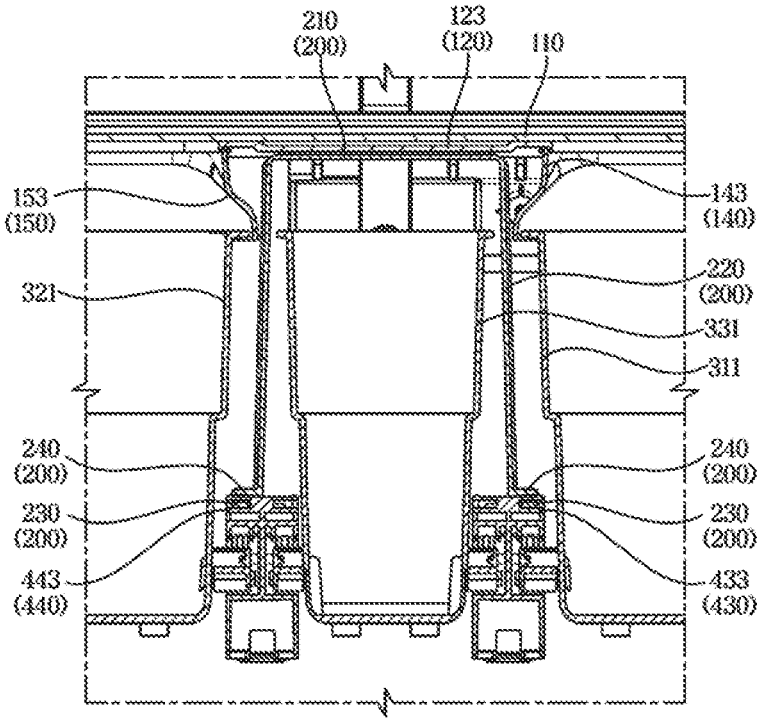
FIG. 7 is a cross-sectional view of a part of FIG. 2, in which a support member is mounted.

FIG. 4 is a perspective view illustrating a state in which a support member 200 of a refrigerator 1 is mounted on the first inner rail 430 and the second inner rail 440 according to an embodiment of the present disclosure. FIG. 5 is an exploded perspective view illustrating the support member 200 and the first inner rail 430 and the second inner rail 440 shown in FIG. 4. FIG. 6 is an enlarged view of a part indicated in FIG. 4. FIG. 7 is a cross-sectional view of a part of FIG. 2, in which a support member 200 is mounted.

Referring to FIG. 4, the load of the shelf assembly 100 may be supported by the support member 200 provided on the lower side of the shelf assembly 100. In addition, the load of the support member 200 may be supported by the pair of inner rails, such as the first inner rail 430 and the second inner rail 440, provided on the lower side of the support member 200.

Hereinafter, a relationship between the support member 200 and the pair of inner rails, such as the first inner rail 430 and the second inner rail 440, is described in detail.

Referring to FIG. 5 and FIG. 6, the support member 200 may include a shelf support portion 210.

The shelf support portion 210 may be provided to include a surface horizontal to the shelf frame 120 while in contact with the shelf frame 120. More specifically, the shelf support portion 210 may be provided to be in contact with a portion of the bottom surface of the shelf frame 120.

The shelf support portion 210 may be provided to prevent the shelf 110 from sagging by being in contact with the cover portion 123 of the shelf frame 120.

The support member 200 may include leg portions 220.

The leg portions 220 may extend downward from the shelf support portion 210. Specifically, the leg portions 220 may extend from both sides of the shelf support portion 210 in a direction toward the inner rails. The leg portions 220 may be provided as a pair of leg portions and may transfer the load received by the support member 200 to the inner rails, respectively. However, the number of leg portions 220 is not limited thereto.

The support member 200 may include extension portions 240.

The extension portions 240 may extend outward from the ends of the leg portions 220 in a horizontal direction. The extension portions 240 may be provided as a pair of extension portions corresponding to the number of the leg portions 220. The extension portions 240 may be provided in parallel with the shelf support portion 210.

The support member 200 may include locking portions 230.

The locking portions 230 may protrude from the extension portions 240 toward the inner rails. The locking portions 230 may be provided in a substantially "c" shape.

The support member 200 may include a rail support portion 250.

The rail support portion 250 may be provided at a height lower than that of the extension portion 240 and may be provided at a height higher than that of the locking portion 230. The rail support portion 250 may be provided to be connected to the extension portion 240 and the locking portion 230. The rail support portion 250 may extend outward from an end of the leg portion 220 in a horizontal direction. That is, the extension portion 240 may be formed at the front end of the leg portion 220, and the rail support portion 250 may be formed at the rear end of the leg portion 220.

The first inner rail 430 may include a pair of first front wheels 431 and a pair of first rear wheels 432.

Among the pair of first front wheels 431 and the pair of first rear wheels 432, the first front wheel and the first rear wheel located on a side facing the second inner rail 440 may allow the sub-drawer 330 to be mounted thereon so as to be slidably movable with respect to the first inner rail 430. In addition, among the pair of first front wheels 431 and the pair of first rear wheels 432, the first front wheel and the first rear wheel located on a side facing away from the second inner rail 440 may allow the first drawer 310 to be mounted thereon so as to be slidably movable with respect to the first inner rail 430.

The first inner rail 430 may include a first insertion portion 433 and a first accommodating space 434.

The first insertion portion 433 may be formed to be open such that the locking portion 230 of the support member 200 is inserted and thus the position of the support member is kept. In other words, the first insertion portion 433 may form a first accommodating space 434 in which the locking portion 230 is accommodated.

The first inner rail 430 may include a first support mounting portion 435.

The first support mounting portion 435 may be provided on an upper surface of the first inner rail 430 to support the load of the support member 200. The first insertion portion 433 may be formed to be stopped from the first support mounting portion 435 such that the locking portion 230 is inserted and fixed thereto.

Therefore, the locking portion 230 of the support member 200 may be supported by the first insertion portion 433 of the first inner rail 430, and the rail support portion 250 of the support member 200 may be supported by the first support mounting portion 435 of the first inner rail 430.

The second inner rail 440 may include a pair of second front wheels 441 and a pair of second rear wheels 442. Among the pair of second front wheels 441 and the pair of second rear wheels 442, the second front wheel and the second rear wheel located on a side facing the first inner rail 430 may allow the sub-drawer 330 to be mounted thereon so as to be slidably movable with respect to the second inner rail 440. Among the pair of second front wheels 441 and the pair of second rear wheels 442, the second front wheel and the second rear wheel located on a side facing away from the first inner rail 430 may allow the second drawer 320 to be mounted thereon so as to be slidably movable with respect to the second inner rail 440.

The second inner rail 440 may include a second insertion portion 443 and a second support mounting portion 445.

In FIG. 6, a state in which the support member 200 is mounted on the first inner rail 430 is illustrated in an enlarged view, but the mounting method of the second inner rail 440 and the support member 200 is also equivalent.

In addition, when the sub-drawer 330 is not mounted between the plurality of drawers 310 and 320, and a component, such as a separate water filter, is mounted, the front and rear wheels of the first inner rail 430 and the second inner rail 440 may not be provided as a pair.

That is, since the first inner rail 430 is provided only to slidably mount the first drawer 310 thereon according to an embodiment, the first inner rail 430 may include a single first front wheel and a single first rear wheel only on a side at which the first drawer 310 is mounted.

Similarly, since the second inner rail 440 is provided only to slidably mount the second drawer 320 thereon according to an embodiment, the second inner rail 440 may include a single second front wheel and a single second rear wheel only on a side at which the second drawer is 320 is mounted.

A method of the support member 200 supporting the shelf assembly 100 and an operation of the sub-drawer 330 is described with reference to FIG. 7, As shown in FIG. 7, the shelf support portion 210 of the support member 200 is provided to support the bottom surface of the cover portion 123 of the shelf frame 120. Accordingly, the load of the shelf frame 120, the shelf 110 seated on the shelf frame 120, and the articles mounted on the shelf 110 may be supported.

The pair of leg portions 220 of the support member 200 may be provided at each end thereof with the extension portion 240. The locking portions 230 extending from the extension portions 240 toward the respective inner rails are inserted into the first insertion portion 433 of the first inner rail 430 and the second insertion portion 433 of the second inner rail 440, so that the position of the support member 200 may be fixed.

With such a configuration, the load applied to the support member 200 may be transferred to the first inner rail 430 and the second inner rail 440 such that the pair of inner rails 430 and 440 support the support member 200.

In addition, the sub-drawer 330 may be movably disposed inside of the support member 200. More specifically, the sub-drawer 330 may be slidably coupled to the first inner rail 430 and the second inner rail 440.

Since the sub-drawer 330 and the support member 200 are formed not to meet each other, interference with the operation of the sub-drawer 330 may not occur while the support member 200 supports the shelf assembly 100.

The load of the shelf assembly 100 may be supported on the side portion by a bead and the like formed on the inner case 11 of the storage compartment.

However, since the central portion of the shelf assembly 100 is supported by the support member 200, deflection in the center of the shelf assembly 100 may be prevented, and strength may be further supplemented.

In addition, as the support member 200 supports the shelf assembly 100, there is no need for a separate member to supplement the strength of the shelf assembly 100, and the glass forming the shelf 110 may be formed thin, and thus manufacturing cost may be reduced.

Figure 8:
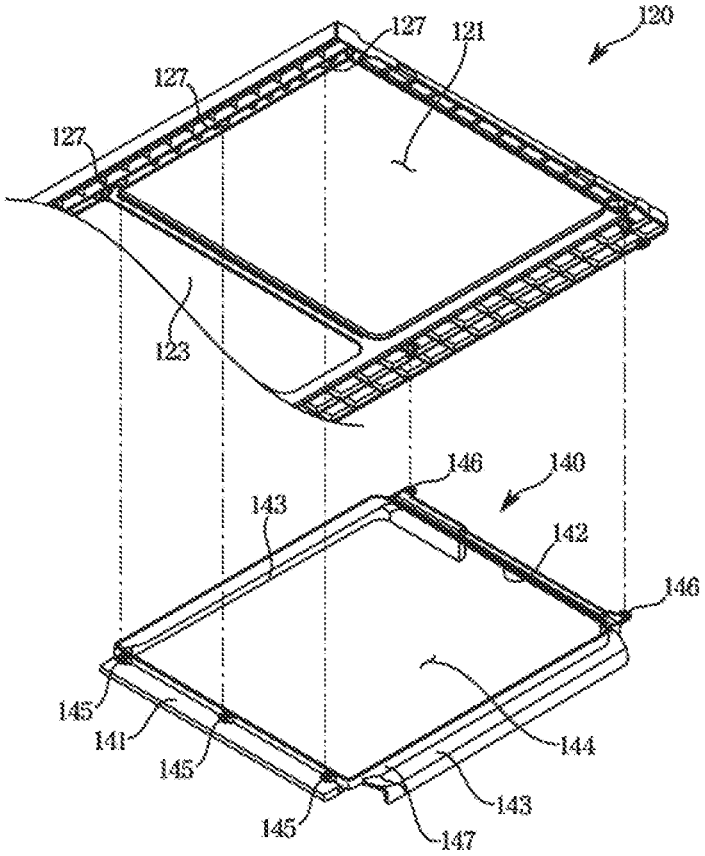
FIG. 8 is a view simultaneously illustrating a bottom surface of a shelf frame and a first drawer cover of a refrigerator according to an embodiment of the present disclosure.
Figure 9:
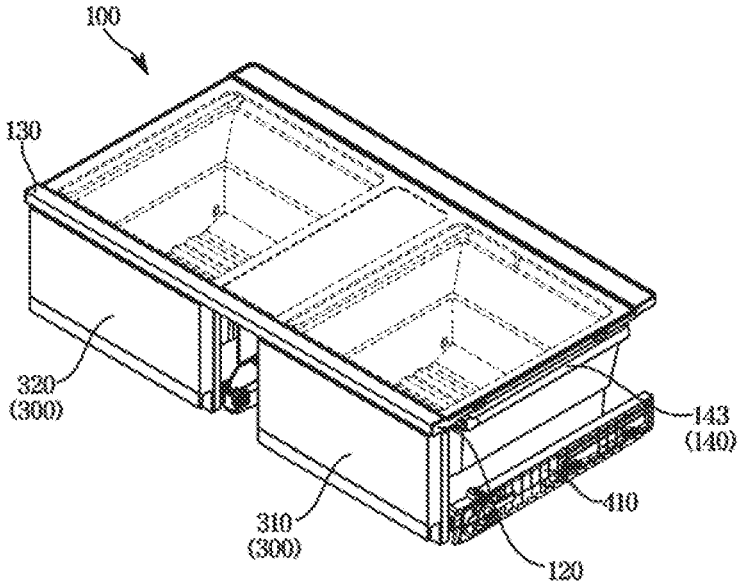
FIG. 9 is a front perspective view illustrating a refrigerator according to an embodiment of the present disclosure, except for a sub-drawer.
Figure 10:
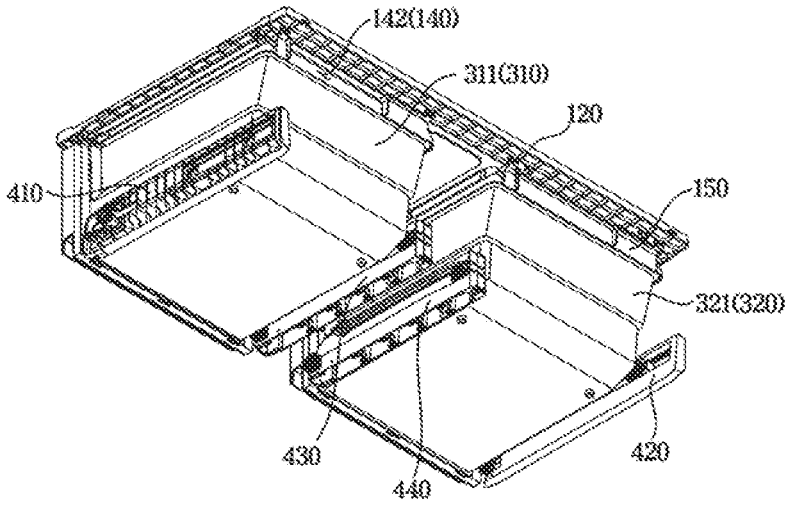
FIG. 10 is a rear perspective view of FIG. 9.

FIG. 8 is a view simultaneously illustrating a bottom surface of a shelf frame 120 and a first drawer cover 140 of a refrigerator 1 according to an embodiment of the present disclosure. FIG. 9 is a front perspective view illustrating a refrigerator 1 according to an embodiment of the present disclosure. FIG. 10 is a rear perspective view of FIG. 9;

Referring to FIG. 8, the shelf frame 120 may include the first opening 121 and the cover portion 123. Details thereof are the same as described above.

The shelf frame 120 may include a support rib 127 formed on a bottom surface. The support rib 127 may be formed in a front lower portion of the shelf frame 120. The support rib 127 may be provided in a bent shape to have an insertion space therein.

The first drawer cover 140 may include the first opening portion 144 to communicate with the first opening 121 of the shelf frame 120. As described above, the first opening portion 144 may be provided to communicate with the first drawer 310. The first drawer cover 140 may include an edge frame 147 formed to surround the first opening portion 144. The edge frame 147 may be formed in a substantially square ring shape.

The first drawer cover 140 may include a cold air blocking portion 141. The cold air blocking portion 141 may extend toward the front of the storage compartment.

Specifically, the cold air blocking portion 141 may extend from the edge frame 147 to a side of the first cover panel 312 of the first drawer 310. The cold air blocking portion 141 may be provided to cover a gap formed between the shelf frame 120 and the first cover panel 312.

The first drawer cover 140 may include a first side rib 143. The first side rib 143 may extend from the edge frame 147 toward the side surface of the storage compartment. The first side rib 143 may be provided to cover a gap formed between the shelf frame 120 and the first storage box 311.

The first side ribs 143 may be provided as a pair.

The first drawer cover 140 may include a mounting protrusion 145. The mounting protrusion 145 may be formed in a front portion of the first drawer cover 140 corresponding to the formation position of the support rib 127.

The mounting protrusion 145 may protrude into the support rib 127 such that the position is fixed by the support rib 127 formed on the bottom surface of the shelf frame 120. The number of mounting protrusions 145 may be formed corresponding in number to the number of support ribs 127.

However, the number of mounting protrusions 145 and support ribs 127 is not limited to those shown in FIG. 8. A detailed coupling structure of the mounting protrusion 145 and the support rib 127 is described below.

The first drawer cover 140 may include a cold air inlet 142.

The cold air inlet 142 may be formed in a rear portion of the first drawer cover 140. Since the duct 50 is mounted on the rear surface of the storage compartment, the cold air inlet 142 of the first drawer cover 140 communicating with the cold air discharge hole 52 of the duct 50 may also be formed in a rear portion of the first drawer cover 140. The cold air inlet 142 may be formed by a rear portion of the first drawer cover 140 that is cut to communicate with the cold air discharge hole 52.

The first drawer cover 140 may include a coupling portion 146.

Through the coupling portion 146 of the first drawer cover 140, the shelf frame 120 and the first drawer cover 140 may be fastened to each other. However, the position of the coupling portion 146 is not limited thereto.

In FIG. 8, the first drawer cover 140 is illustrated and described, and the second drawer cover 150 may also have the same configuration as that of the first drawer cover 140 except that the cold air inlet 142 is not formed. As shown in FIG. 7, the second drawer cover 150 may include a second side rib 153.

In addition, the embodiment of the second drawer cover 150 is not limited thereto, and when a plurality of cold air outlets 51 of the duct 50 are formed, the second drawer cover 150 may also have a cold air inlet 142.

A state in which the first drawer 310 and the second drawer 320 are mounted on the shelf assembly 100 is described with reference to FIG. 9 and FIG. 10.

While the first drawer 310 is mounted on the shelf assembly 100, a gap generated between the first drawer 310 and the shelf frame 120 may be covered by the first side rib 143 of the first drawer cover 140.

With such a configuration, cold air inside the first drawer 310 leaking to the storage compartment may be minimized. That is, the temperature inside the first drawer 310 provided to have a temperature different from that of the storage compartment may be maintained at a constant temperature through the cold air inlet 142.

Figure 11:
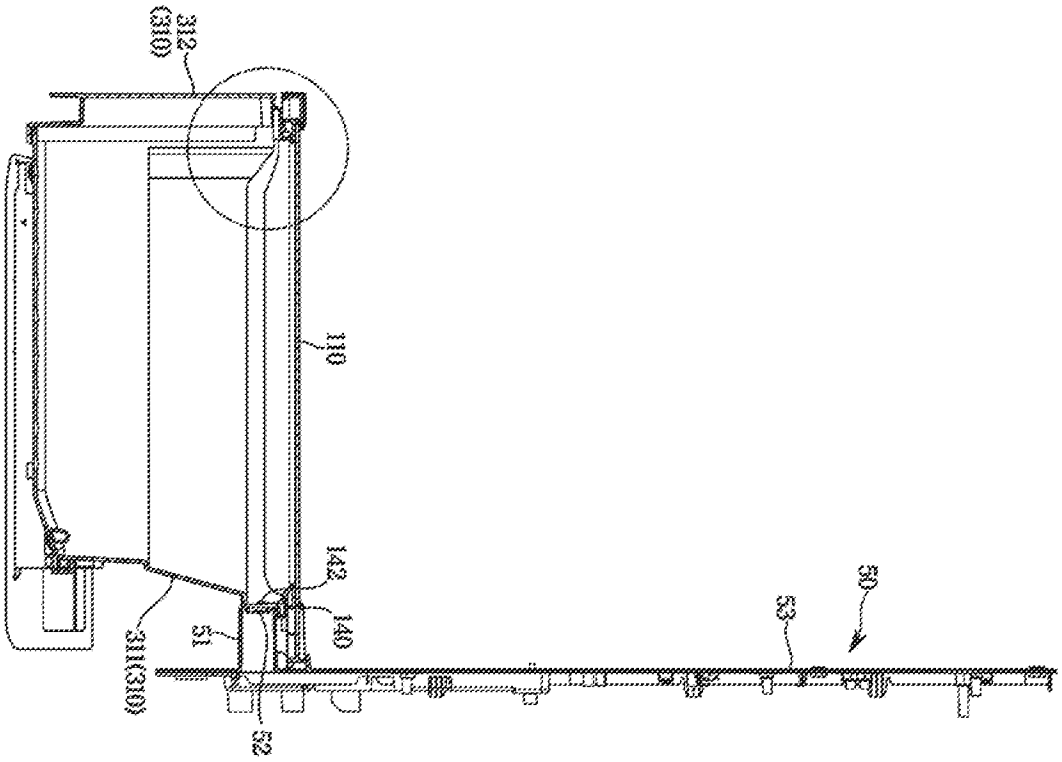
FIG. 11 is a cross-sectional side view illustrating a part of a refrigerator according to an embodiment of the present disclosure, in which a first drawer cover is mounted.
Figure 12:
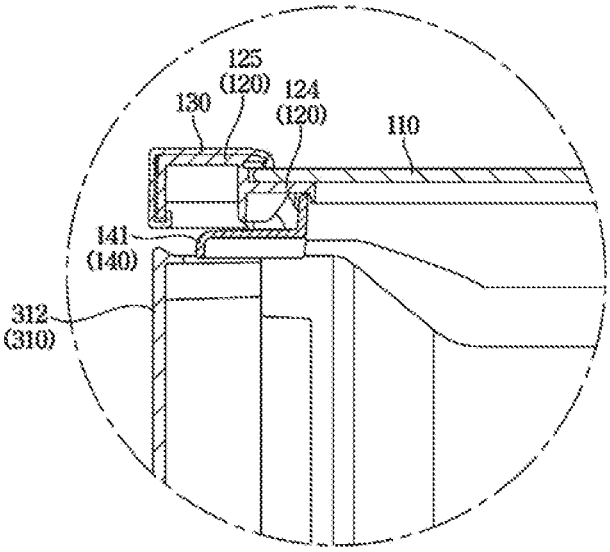
FIG. 12 is an enlarged view of a part indicated in FIG. 11.
Figure 13:
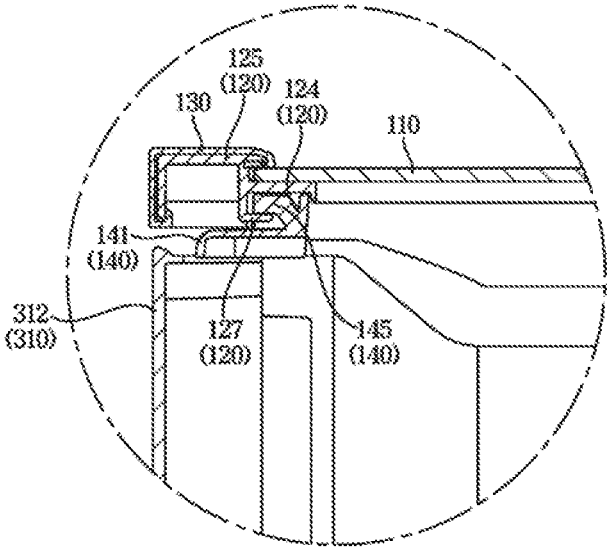
FIG. 13 is an enlarged cross-sectional view illustrating coupling between a first drawer cover and a shelf frame according to an embodiment of the present disclosure.

FIG. 11 is a cross-sectional side view illustrating a part of a refrigerator 1 according to an embodiment of the present disclosure, in which a first drawer cover 140 is mounted. FIG. 12 is an enlarged view of a part indicated in FIG. 11. FIG. 13 is an enlarged cross-sectional view illustrating coupling between a first drawer cover 140 and a shelf frame 120 according to an embodiment of the present disclosure.

Referring to FIG. 11, cold air generated by the cooling system of the refrigerator 1 may flow into the cold air discharge hole 52 formed in the cold air outlet 51 of the duct 50.

Since the cold air inlet 142 of the first drawer cover 140 and the cold air discharge hole 52 of the duct 50 communicate with each other, the cold air may flow into the first drawer 310. More specifically, cold air may flow into the space formed by the first storage box 311 and the first cover panel 312.

Referring to FIG. 12, the cold air blocking portion 141 of the first drawer cover 140 may be provided to cover a gap between the shelf frame 120 and the first cover panel 312. With such a configuration, the amount of cold air inside the first drawer 310 leaking to the storage compartment may be minimized.

In addition, the shelf 110 may be seated on the shelf mounting portion 124 of the shelf frame 120. The trim 130 may be coupled to the front of the shelf frame 120 to surround the front frame portion 125 of the shelf frame 120. At the same time, the trim 130 may be provided to press the upper surface of the shelf 110. With such a configuration, the shelf 110 may be prevented from moving upward and escaping from the shelf frame 120.

Referring to FIG. 13, the mounting protrusion 145 of the first drawer cover 140 may be inserted into the support rib 127 of the shelf frame 120. More specifically, the support rib 127 of the shelf frame 120 may be provided in a "c" shape to accommodate the mounting protrusion 145 of the first drawer cover 140.

With such a configuration, the positions of the first drawer cover 140 and the shelf frame 120 may be fixed without being coupled with a separate fastening member.

A specific shape and a specific direction of a washing machine have been described above with reference to the accompanying drawings, but the present disclosure may be variously modified and changed by those skilled in the art, and the modifications and changes should be interpreted as being included in the scope of the present disclosure.

What is claimed is:

1. A refrigerator comprising:

a storage compartment;

a shelf provided in the storage compartment;

a shelf frame provided at a lower side of the shelf and configured to support the shelf;

a drawer and a sub-drawer that are configured to be withdrawn at a lower side of the shelf frame by being withdrawn from the storage compartment along a first direction;

a drawer cover coupled to the shelf frame between the shelf frame and the drawer, the drawer cover comprising a cold air blocking portion extending toward a front of the storage compartment; and a support member contacting a portion of a bottom surface of the shelf frame and configured to support a load of the shelf, wherein at least part of the support member is, in a second direction perpendicular to the first direction, between the sub-drawer and the shelf frame, wherein the support member comprises:

a shelf support portion comprising a surface, as the at least part of the support member, parallel to the shelf frame and contacting the shelf frame; and a leg portion extending downward from the shelf support portion, wherein the refrigerator further comprises:

a plurality of drawers comprising the drawer and a second drawer; and inner rails to which inner sides of the plurality of drawers are respectively coupled in a sliding manner, and wherein the support member further comprises:

an extension portion extending horizontally outward from an end of the leg portion; and a locking portion protruding from the extension portion and toward at least one of the inner rails.

2. The refrigerator of claim 1, wherein the inner rails comprise an insertion portion configured to receive the locking portion and lock the support member in position.

3. The refrigerator of claim 1, wherein the sub-drawer is provided between the drawer and the second drawer, wherein the sub-drawer is slidably coupled to the inner rails, and wherein the sub-drawer is at least partly disposed inside of the support member.

4. The refrigerator of claim 1, wherein the drawer comprises:

a storage box; and a cover panel coupled to a front side of the storage box and comprising a grip.

5. The refrigerator of claim 4, wherein the cover panel further comprises an edge frame surrounding an opening portion that is open to an inside of the drawer.

6. The refrigerator of claim 5, wherein the cold air blocking portion extends from the edge frame to a side of the cover panel of the drawer and covers a gap between the shelf frame and the cover panel.

7. The refrigerator of claim 5, wherein the drawer cover further comprises a side rib extending from the edge frame and toward a side surface of the storage compartment, and wherein the side rib covers a gap between the shelf frame and the storage box.

8. The refrigerator of claim 5, wherein the shelf frame comprises:

an opening that is open to the opening portion of the drawer cover; and a cover portion supported by the support member.

9. The refrigerator of claim 1, wherein the shelf frame comprises a shelf seating portion on which the shelf is seated, and wherein the shelf seating portion is stepped inward from an upper surface of the shelf frame.

10. The refrigerator of claim 9, further comprising a trim coupled to a front side of the shelf frame, wherein the trim is configured to press the shelf seated on the shelf seating portion from an upper side.

11. The refrigerator of claim 1, further comprising a duct mounted on a rear surface of the storage compartment, wherein the duct is configured to supply air into the storage compartment, wherein the duct comprises an air discharge hole, and wherein the drawer cover further comprises an air inlet in communication with the air discharge hole.

12. The refrigerator of claim 1, wherein the shelf frame comprises a support rib on the bottom surface, and wherein the drawer cover comprises a mounting protrusion protruding to an inside of the support rib and configured to keep the drawer cover in position by engagement with the support rib.

* * * * *